US010547151B2

(12) United States Patent
Powers et al.

(10) Patent No.: US 10,547,151 B2
(45) **Date of Patent: *Jan. 28, 2020**

(54) MAGNETIC ADAPTER

(71) Applicant: Apple Inc., Cupertino, CA (US)

(72) Inventors: Ronald G. Powers, Scotts Valley, CA (US); Kevin M. Keeler, Goleta, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/997,489

(22) Filed: Jun. 4, 2018

(65) Prior Publication Data

US 2018/0375271 A1 Dec. 27, 2018

Related U.S. Application Data

(63) Continuation of application No. 14/986,742, filed on Jan. 4, 2016, now Pat. No. 9,991,657.

(60) Provisional application No. 62/235,146, filed on Sep. 30, 2015.

(51) Int. Cl.

| | |
|---|---|
| ***H01R 13/60*** | (2006.01) |
| ***H01R 31/06*** | (2006.01) |
| ***H01R 13/62*** | (2006.01) |
| ***H01R 24/60*** | (2011.01) |

(52) U.S. Cl.

CPC ..... *H01R 31/06* (2013.01); *H01R 13/6205* (2013.01); *H01R 24/60* (2013.01); *H01R 31/065* (2013.01)

(58) Field of Classification Search

CPC ... H01R 31/065; H01R 13/6205; H01R 24/60

See application file for complete search history.

(56) References Cited

U.S. PATENT DOCUMENTS

| | | | |
|---|---|---|---|
| 2,749,526 | A | 6/1956 | Peterson |
| 4,421,371 | A | 12/1983 | Clark |
| 4,579,410 | A | 4/1986 | Soloman |
| 4,640,570 | A | 2/1987 | Strate |
| 5,885,109 | A | 3/1999 | Lee |
| 6,565,363 | B2 | 4/2003 | Downing |
| 6,669,513 | B2 | 12/2003 | Huang |
| 6,733,329 | B2 | 5/2004 | Yang |
| 7,331,793 | B2 | 2/2008 | Hernandez |
| 7,354,315 | B2 | 4/2008 | Goetz |
| 7,356,715 | B2 | 4/2008 | Okayasu |
| 7,412,552 | B2 | 8/2008 | Jones |
| 7,841,776 | B2 | 11/2010 | DiFonzo |

(Continued)

FOREIGN PATENT DOCUMENTS

| | | |
|---|---|---|
| DE | 19923705 | 11/2000 |
| JP | 04317899 | 11/1992 |

*Primary Examiner* — Xuong M Chung Trans

(74) *Attorney, Agent, or Firm* — Kilpatrick Townsend & Stockton, LLP

(57) ABSTRACT

Connector adapters that may have a MagSafe connector receptacle and a Universal Serial Bus Type-C connector insert. This may allow MagSafe chargers to be used to charge devices having Universal Serial Bus Type-C connector receptacles. This also may provide the breakaway characteristic of a MagSafe connector system for a device that does not include a MagSafe connector receptacle. Other adapters may have other types of magnetic connector receptacles and connector inserts.

15 Claims, 5 Drawing Sheets

(56) References Cited

U.S. PATENT DOCUMENTS

| | | | | |
|---|---|---|---|---|
| 7,909,651 | B2 | 3/2011 | Kim | |
| 8,147,270 | B1 | 4/2012 | Wescott | |
| RE44,072 | E | 3/2013 | Milan | |
| 8,398,409 | B2 | 3/2013 | Schmidt | |
| 8,478,912 | B2 | 7/2013 | Liu | |
| 8,517,766 | B2 * | 8/2013 | Golko | H01R 13/516 439/607.41 |
| 8,539,125 | B1 | 9/2013 | Ford | |
| 8,601,173 | B2 | 12/2013 | Sung | |
| 8,686,600 | B2 * | 4/2014 | Terlizzi | H01R 13/6683 307/125 |
| 8,702,928 | B2 | 4/2014 | Ralston | |
| 8,934,261 | B2 * | 1/2015 | Lin | H01R 13/111 361/792 |
| 9,017,092 | B1 | 4/2015 | McCracken | |
| 9,106,031 | B2 * | 8/2015 | Golko | H01R 13/516 |
| 9,209,547 | B2 | 12/2015 | Lozano Villarreal | |
| 9,459,670 | B2 * | 10/2016 | Rich | G06F 1/1632 |
| 9,478,905 | B2 * | 10/2016 | Golko | H01R 13/516 |
| 9,577,392 | B2 | 2/2017 | Chang | |
| 9,588,560 | B2 | 3/2017 | Talmola | |
| 9,606,953 | B2 | 3/2017 | Talmola | |
| 9,991,657 | B2 * | 6/2018 | Powers | H01R 31/06 |
| 2008/0084530 | A1 | 4/2008 | Hirabayashi | |
| 2009/0117768 | A1 | 5/2009 | Liao | |
| 2009/0198841 | A1 | 8/2009 | Yoshida | |
| 2011/0021040 | A1 | 1/2011 | Garb | |
| 2012/0200173 | A1 | 8/2012 | Liu | |
| 2013/0217274 | A1 | 8/2013 | Bar-Niv | |
| 2014/0193997 | A1 | 7/2014 | Lam | |

* cited by examiner

MAGNETIC ADAPTER

CROSS-REFERENCES TO RELATED APPLICATIONS

This application is a continuation of U.S. patent application Ser. No. 14/986,742, filed Jan. 4, 2016, which claims the benefit of U.S. provisional patent application No. 62/235,146, filed Sep. 30, 2015, which are incorporated by reference.

BACKGROUND

The number and types of electronic devices available to consumers have increased tremendously the past few years and this increase shows no signs of abating. Electronic devices, such as portable media players, storage devices, tablets, netbooks, laptops, desktops, all-in-one computers, wearable computing devices, smart phones, televisions, monitors and other display devices, navigation systems, and other devices have become ubiquitous in recent years.

These devices often receive power and share data using various cables. These cables may have connector inserts, or plugs, on one or both ends. The connector inserts may plug into connector receptacles on electronic devices, thereby forming one or more conductive paths between devices for signals and power.

But these cables may create hazards. For example, a user may place an electronic device, such as a laptop, on a desk or table. The desk or table may be a distance from an electrical outlet. The user may plug a charger into the remote outlet and may plug a connector insert of the charger into a connector receptacle on the laptop. A power cord may then span the distance from the laptop to the remote outlet.

Particularly where the desk or table is in a public or semi-public environment, such as a library or coffee shop, the power cord may become a tripping hazard. When this occurs, a force applied to the cable may be transferred and applied to the connector insert. This inadvertent force on the connector insert may damage the connector receptacle, the electronic device housing the connector receptacle, or both. In more severe situations, the laptop may be pulled to the ground, thereby causing damage.

Thus, what is needed are components for connector systems such that when a connector insert is mated with a connector receptacle, damage to the connector receptacle and electronic device may be avoided in the event of an inadvertent force on the connector insert.

SUMMARY

Accordingly, embodiments of the present invention may provide components for connector systems such that when a connector insert is mated with a connector receptacle, damage to the connector receptacle and electronic device may be avoided in the event of an inadvertent force on the connector insert.

An illustrative embodiment of the present invention may provide a connector adapter having a connector insert and a magnetic connector receptacle. The magnetic connector receptacle on the adapter may receive a corresponding magnetic connector insert that may be connected to a charger through a cable. The connector insert of the adapter may be inserted into a connector receptacle on an electronic device. When an inadvertent force is applied to the magnetic connector insert of the charger via the cable, the magnetic connector insert of the charger and magnetic connector receptacle of the adapter may disengage, thereby preventing or limiting damage to the connector receptacle on the electronic device, as well as to the electronic device itself. This adapter may also allow users to use an existing charger with a magnetic connector insert to charge a new device having different connector receptacle.

These and other embodiments of the present invention may provide a connector adapter having a magnetic connector receptacle. The magnetic connector receptacle may include a plurality of magnets and a plurality of contacts. The contacts may include a center contact, ground contacts on each side of the center contact, and power contacts between the center contact and the ground contacts. The center contact may be a signal or detect or other type of contact. The contacts may be arranged in a symmetrical line. The contacts may be on a raised surface or portion surrounded by a recess. In these and other embodiments of the present invention, the magnetic connector receptacle may be a MagSafe connector receptacle. This may provide the breakaway protection of a MagSafe connector system for a device that does not include a MagSafe connector receptacle.

These and other embodiments of the present invention may provide a connector adapter having a connector insert, where the connector insert may be a Universal Serial Bus or other type of connector insert. For example, the connector insert may be a micro Universal Serial Bus connector insert, a Universal Serial Bus Type-C connector insert, or other type of Universal Serial Bus connector insert. The ground contacts and power supply contacts of the magnetic connector receptacle may connect to ground contacts and power supply contacts of the connector insert.

These and other embodiments of the present invention may provide a connector adapter having various components to facilitate the charging of the electronic device using the charger. For example, a pull-down resistor may be connected between the center contact of the MagSafe connector receptacle and a ground contact. This resistance may be detected by the charger, after which the charger may provide power with a low series impedance to the MagSafe connector receptacle of the adapter. It should be noted that contacts of a Universal Serial Bus connector insert are covered such that contacts carrying voltages are not directly exposed when the adapter is connected to the charger but the connector insert of the adapter is not inserted in the electronic device. In these and other embodiments of the present invention, a pull-up resistor may be coupled between a connection detection contact of a Universal Serial Bus Type-C connector insert and a power supply contact of the MagSafe connector receptacle. The Universal Serial Bus Type-C connector receptacle on the electronic device may detect this pull-up resistor and determine that it is connected to a power providing device. In this case, the Universal Serial Bus Type-C connector receptacle may not provide power but may be configured to receive power from the charger through the adapter.

While embodiments of the present invention are well-suited for connector adapters, in other embodiments of the present invention, the MagSafe connector receptacle and USB Type-C connector insert may be connectors on a dongle or cable adapter that may also include one or more additional connector receptacles, such as an High-Definition Multimedia Interface® connector receptacle, a Video Graphics Array (VGA) connector receptacle, and other types of connector receptacles.

In various embodiments of the present invention, the components of the adapters may be formed in various ways of various materials. For example, contacts or pins, interconnect lines, and other conductive portions of the adapters may be formed by stamping, metal-injection molding, machining, printing, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the adapter housing, raised surface, and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide adapters that may connect to connector receptacles on various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may be compliant with various standards such as Universal Serial Bus (USB), USB2, USB3, USB Type-C, HDMI, Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), VGA, clock signals, power signals, and other types of standard, non-standard, and proprietary interfaces and combinations thereof that have been developed, are being developed, or will be developed in the future. In various embodiments of the present invention, these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
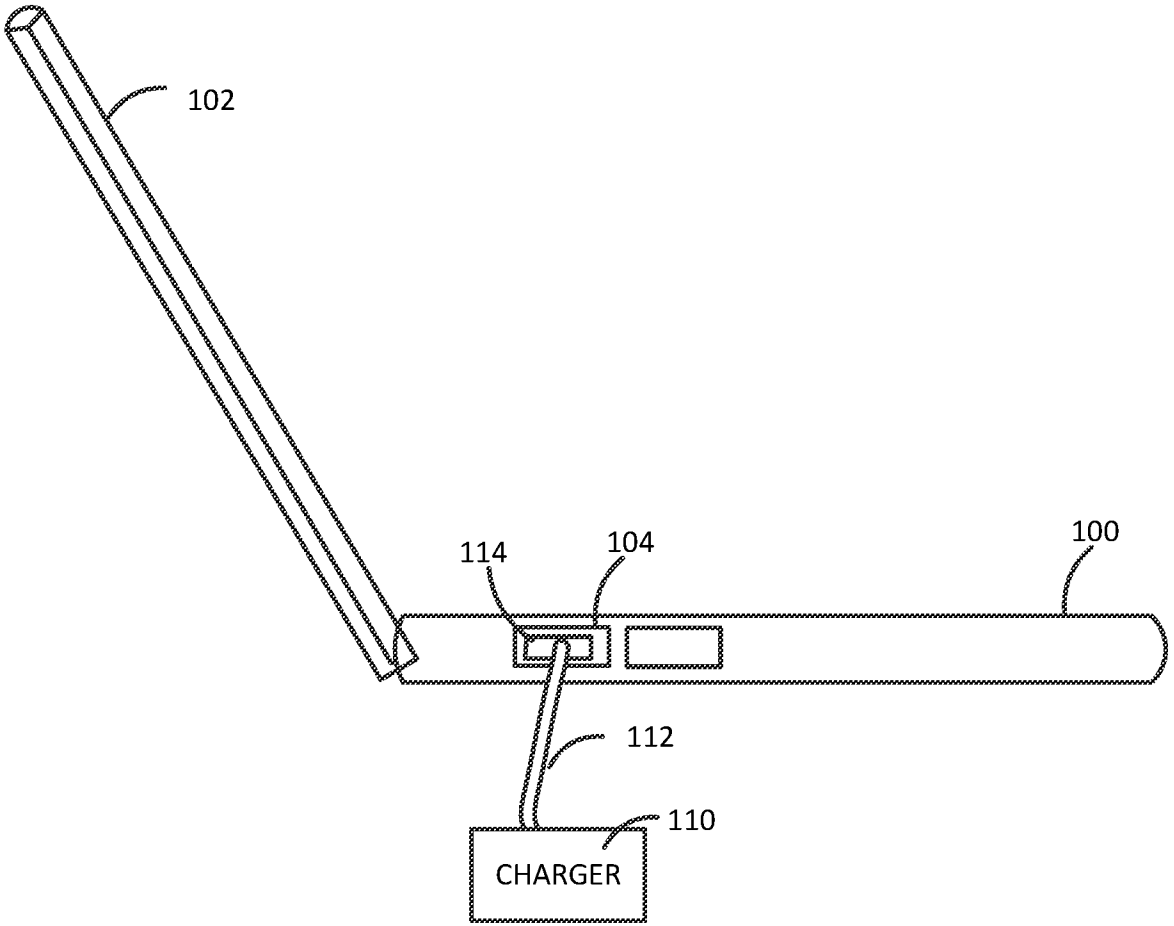
FIG. 1 illustrates an electronic system that may be improved by the incorporation of an embodiment of the present invention.

FIG. 1 illustrates an electronic system that may be improved by the incorporation of an embodiment of the present invention. This figure, as with the other included figures, is shown for illustrative purposes and does not limit her either the possible embodiments of the present invention or the claims.

This figure illustrates an electronic device being charged by a charger. Specifically, laptop 100 may be charged by charger 110. Charger 110 may be plugged into a power outlet (not shown.) Cable 112 may be attached to charger 110, which may terminate in connector insert 114. Laptop 100 may include a screen 102 and connector receptacle 104. Connector receptacle 104 may accept connector insert 114. Power may be provided from the wall outlet through charger 110 and cable 112 to connector receptacle 104 via connector insert 114.

Again, a user may place laptop 100 on a desk, table, or other surface. The wall outlet may be remote from the desk. Accordingly, charger 110 may be plugged into the remote outlet and cable 112 may traverse the distance between the outlet and the laptop 100 and desk. In this arrangement, cable 112 may become a tipping hazard. That is, passersby or the user may trip over cable 112. If connector insert 114 and connector receptacle 104 are like most connectors, the force on cable 112 may be applied to connector insert 114. This force on connector insert 114 may be transferred to connector receptacle 104 and laptop 100. This force may damage connector receptacle 104 or it may pull the laptop off of the desk. Either of these events may cause damage to laptop 100.

Accordingly, embodiments of the present invention may provide a connector adapter. This adapter may include a connector insert and a magnetic connector receptacle. A charger may be attached to a magnetic connector insert via a cable. The magnetic connector insert may plug into the magnetic connector receptacle of the adapter. The connector insert on the adapter may plug into connector receptacle 104 on laptop 100. When a force is applied to the cable, the magnetic connector insert of the charger may break away from the magnetic connector receptacle on the adapter. This may prevent damage to connector receptacle 104, laptop 100, or both. This arrangement may also allow the usage of a charger with a magnetic connector insert that the user may already own. Accordingly, these adapters may provide a breakaway mechanism that may protect connector receptacle 104 and laptop 100, and may allow a user to use a presently-owned charger to charge laptop 100. An example of such an adapter is shown in the following figure.

Figure 2:
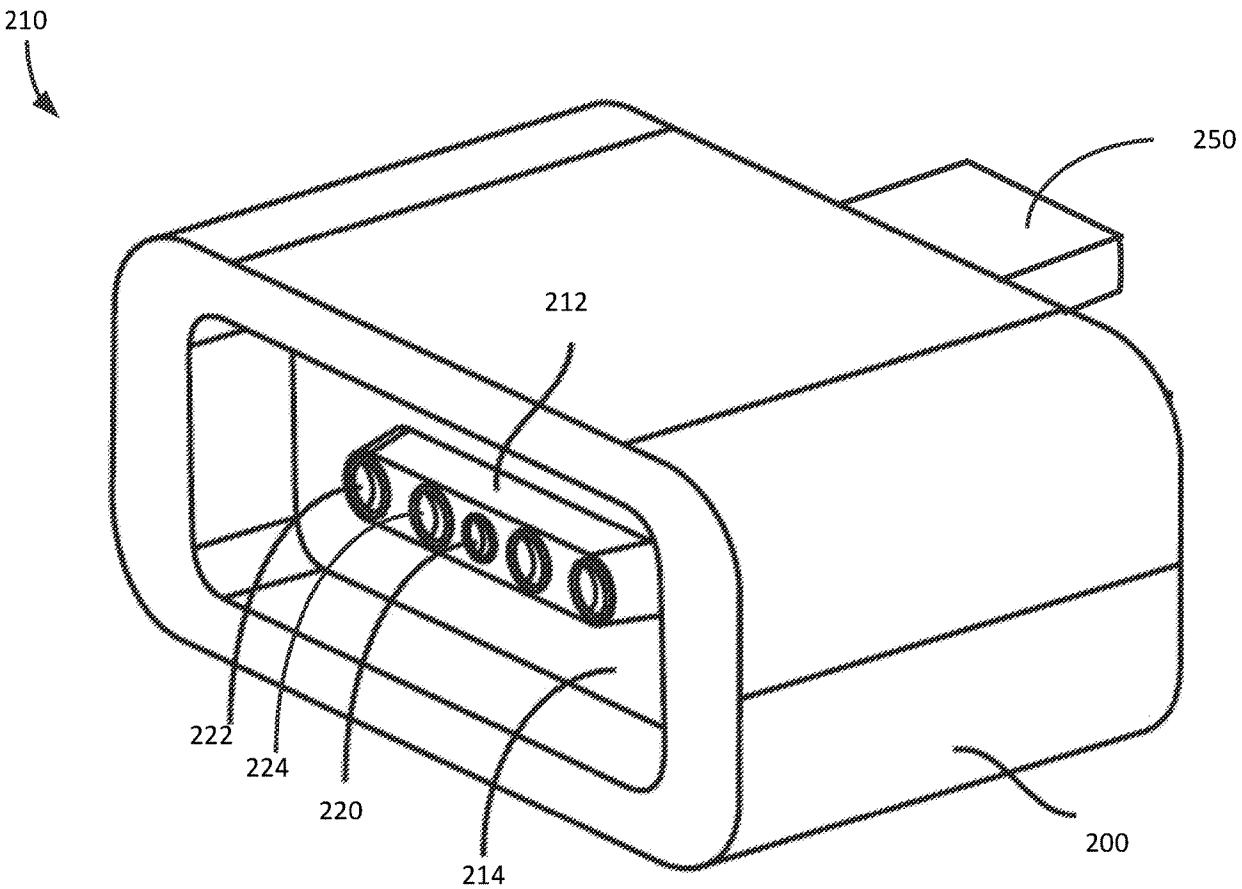
FIG. 2 illustrates a connector adapter according to an embodiment of the present invention.

FIG. 2 illustrates a connector adapter according to an embodiment of the present invention. Connector adapter 200 may include magnetic connector receptacle 210 and connector insert 250. Magnetic connector receptacle 210 may be a MagSafe connector receptacle or other magnetic connector receptacle. Further, magnetic connector receptacle 210 may be one of the various versions of the MagSafe connector receptacle that were available in the past, are currently available, or that may be developed and made available in the future.

Connector insert 250 may be a Lightning connector, a USB connector, or other type of connector. When connector insert 250 is a USB connector, it may be a USB connector, a USB3 connector, a USB Type-C connector, or other type of USB connector that was available in the past, is currently available, or that may be developed and made available in the future. In one embodiment of the present invention, connector insert 250 may be a combination Lightning and USB3 type connector.

The magnetic connector receptacle 210 may include a raised portion 212 supporting a number of contacts. A recess may surround the raised portion 212. Contacts may include a signal or signal/detect contact 220, power supply contacts 224 on either side of the contact 220, and ground contacts 222 on the ends of the raised portion 212.

Again, a MagSafe charger having a magnetic connector insert may plug into magnetic connector receptacle 210 of adapter 200. Connector insert 250 may plug into a connector receptacle on an electronic device. This arrangement may provide a breakaway capability between a magnetic connector insert of a charger and a magnetic connector receptacle of an adapter, which may protect the electronic device. It may also allow a user to employ a charger that is already owned by the user for charging the electronic device. An example is shown in the following figure.

Figure 3:
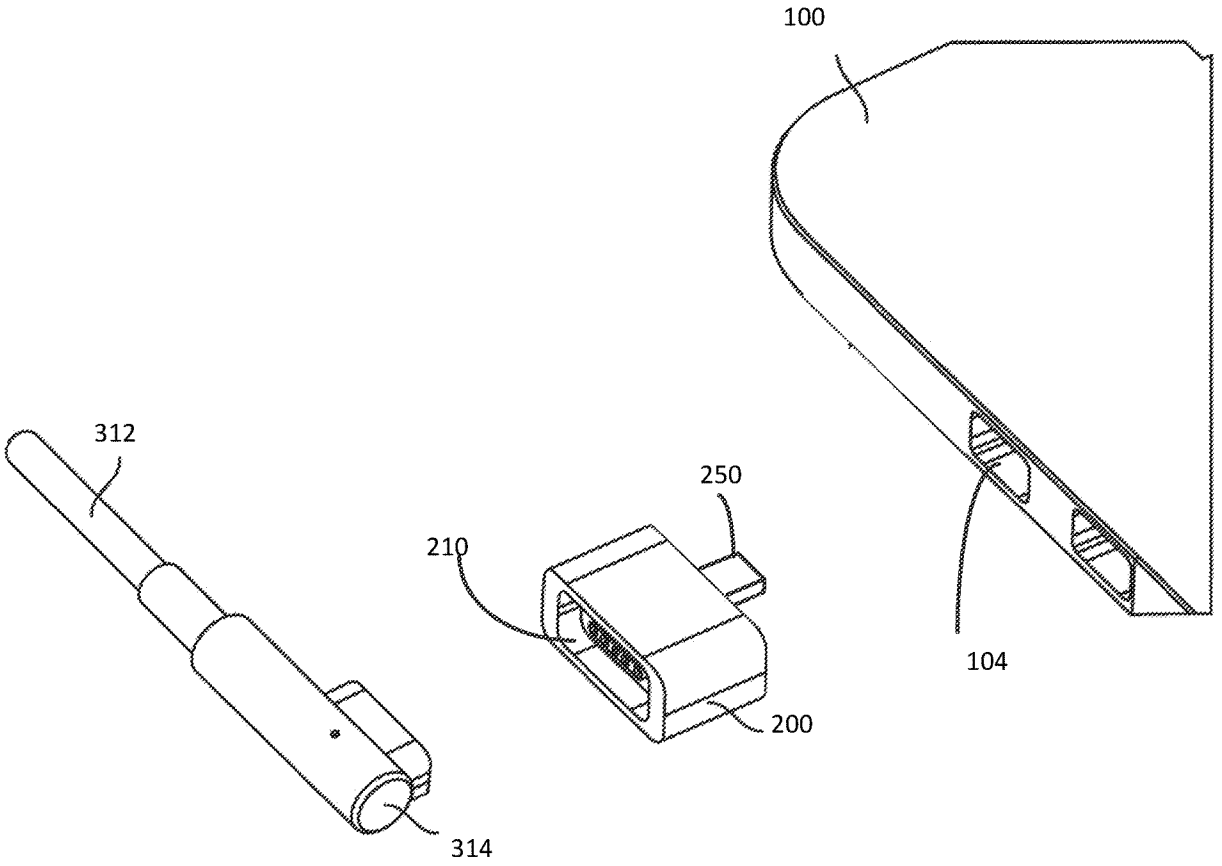
FIG. 3 illustrates an electronic system according to an embodiment of the present invention.

FIG. 3 illustrates an electronic system according to an embodiment of the present invention. Again, a user may already own a charger (not shown) that terminates in magnetic connector insert 314 via a cable 312. Magnetic connector insert 314 may plug into magnetic connector receptacle 210 on connector adapter 200. Again, this may provide this system with a breakaway capability of a MagSafe or similar connector, even though electronic device 100 may not include a MagSafe connector. Connector insert 250 may be inserted into connector receptacle 104. In this way, power provided by the charger through cable 312 and magnetic connector insert 314 may be applied through adapter 200 to connector receptacle 104, where it may charge electronic device 100.

Again, in an embodiment of the present invention, magnetic connector receptacle 210 of adapter 200 may be a MagSafe connector, while connector insert 250 may be a USB Type-C connector. Both MagSafe and USB Type-C connector systems require a detection of a connection before more than a limited amount of power may be provided or received. Accordingly, these and other embodiments of the present invention may provide components for connection detection such that the MagSafe interface associated with the charger and the USB Type-C interface associated with connector receptacle 104 on electronic device 100 may detect a connection such that the MagSafe interface may charge electronic device 100 through the USB Type-C connector receptacle 104. An example is shown in the following figure.

Figure 4:
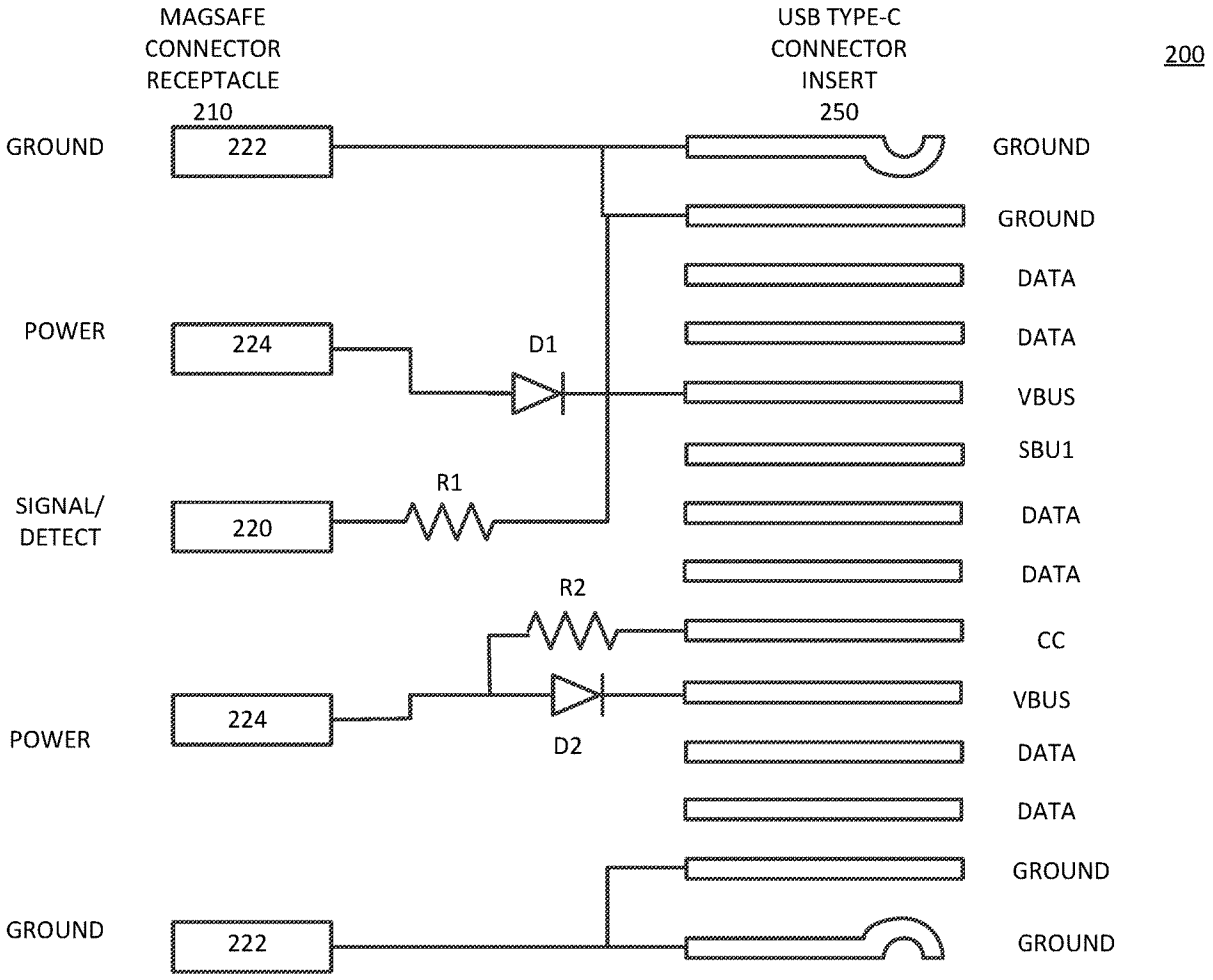
FIG. 4 is a schematic of a connector adapter according to an embodiment of the present invention.

FIG. 4 is a schematic of a connector adapter according to an embodiment of the present invention. In this example, ground contacts 222 of MagSafe connector receptacle 210 may electrically connect to ground contacts and side ground contacts in USB Type-C connector insert 250. Power contacts 224 on MagSafe connector receptacle 210 may connect to VBUS power supply contacts in the USB Type-C connector insert 250.

When a MagSafe connector insert detects a pull-down resistance on its signal/detect contact 220, a source impedance at power supply contacts 222 may drop from a high value to a low value. This high impedance in the absence of a connection may protect users from exposure to voltages on power supply contacts 222 that may supply a large amount of current when a MagSafe connector insert is not inserted into a MagSafe connector receptacle. Accordingly, connector adapter 200 may include resistor R1. Resistor R1 may be connected between signal/detect contact 220 in MagSafe connector receptacle 210 and ground. In this way, when MagSafe connector insert 314 is inserted into MagSafe connector receptacle 210, the charger may provide power having a low source impedance that may be used to charge electronic device 100. It should be noted that this voltage may be provided even though the USB Type-C connector insert 250 is not inserted into electronic device 100. In this case though, the VBUS power contacts of connector insert 250 may be shielded and recessed inside of connector insert 250, and may therefore be unlikely to be inadvertently contacted by a user.

A USB Type-C interface that may accept charge from a charging device may one of two types of ports that may be referred to as an upward-facing port and a dual-role port. If connector receptacle 104 is a dual-role port, when it detects a pull-up resistor on its connection detect contact, the dual-port may detect a connection and be configured as an upward-facing port ready to accept a charging current. An upward-facing port is already configured to accept a charging current and a connection to a charging device is detected with the pull-up resistor. Accordingly, embodiments of the present invention may employ resistor R2, which may be connected as a pull-up resistor between the connection detect or CC contact of USB Type-C connector insert 250 and a power supply contact 222 in MagSafe connector receptacle 210.

USB Type-C interfaces for upward-facing ports, and dual-role ports acting as upward-facing ports, may provide an internal resistor to ground from the connection detect or CC contact, or they may provide a current to ground from the connection detect or CC contact. The USB Type-C interface may also require that the voltage on the connection detect or CC contact be within a specified range, have a maximum or minimum voltage, or both, before a connection is properly detected. Accordingly, embodiments of the present invention may provide a pull-up resistor R2 having a resistance that provides a resulting voltage on the connection detect or CC contact that meets the required voltage range or limits.

When connector receptacle 104 is a dual-role port, it may be capable of providing power back through the MagSafe connector receptacle 210 to the MagSafe connector insert 314. To prevent this, diodes D1 and D2 may be used. These diodes may be in series with the power supply lines and may protect MagSafe connector insert 314 from current that may be provided by VBUS contacts in connector insert 250. Further, these diodes D1 and D2 may be light-emitting diodes (LEDs) that may be used to provide indicating lights on connector adapter 200. In various embodiments of the present invention, the current into a USB Type-C connector receptacle or other type of connector receptacle may be too large to be handled by an LED. Accordingly, in various embodiments of the present invention, a branch or portion of the supply current may pass through diodes D1 and D2 while the remaining supply current may flow through other diodes or other components (not shown.) In still other embodiments of the present invention, other indicators or LEDs may be used in other configurations.

Connector adapter 200 may be assembled in various ways. An example is shown in the following figure.

Figure 5:
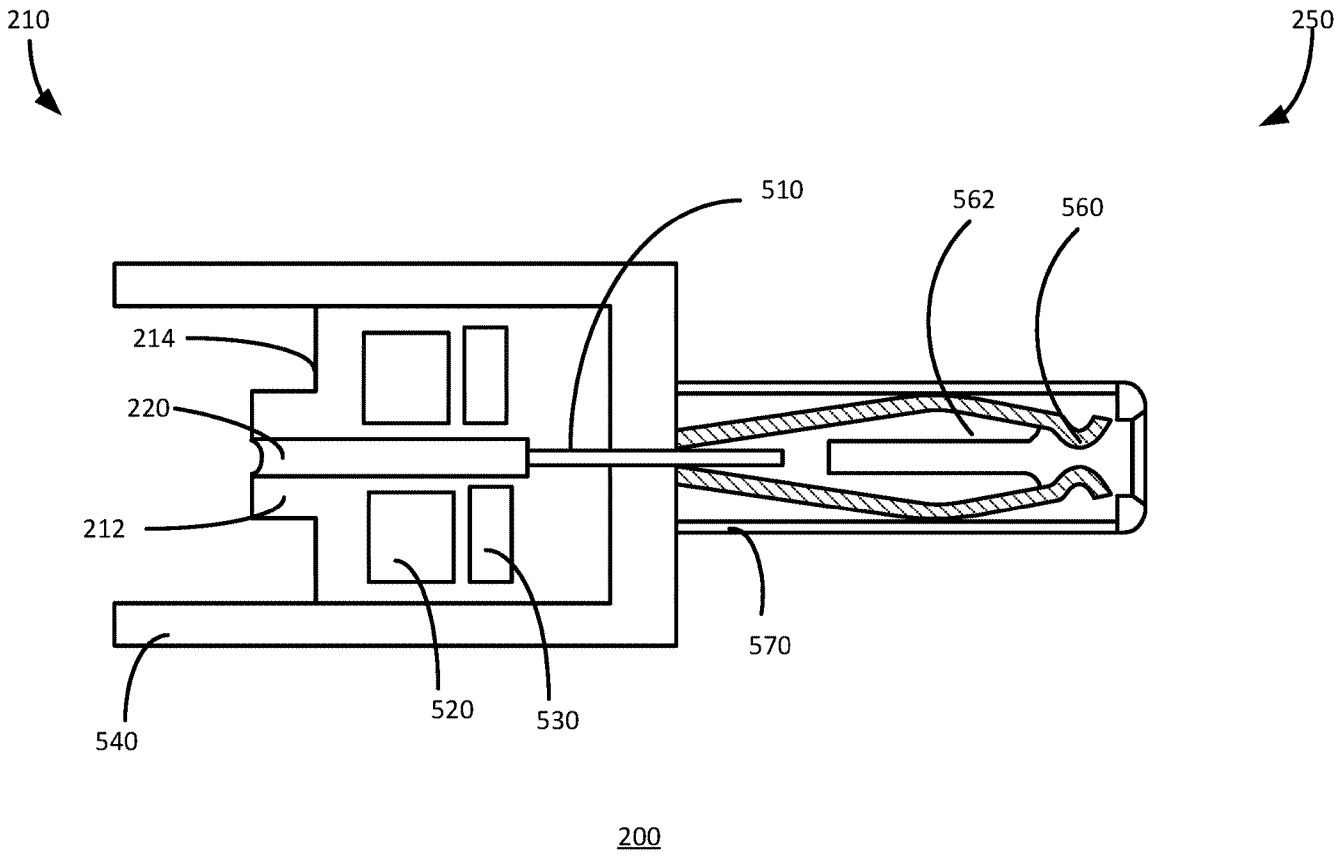
FIG. 5 illustrates a cut-away side view of a connector adapter according to an embodiment of the present invention.

FIG. 5 illustrates a cut-away side view of a connector adapter according to an embodiment of the present invention. Magnetic connector receptacle 210 may include a housing 540 and around a nonconductive inner housing 214. Nonconductive inner housing 214 may include contacts 220 terminating in board 510. Magnets 520 may be placed around the contacts 220. In a specific embodiment of the present invention, four magnets 520 may be used. Back plate 530 may be used to direct the flux through magnets 520. Connector insert 250 may include contacts 560 surrounded by shield 570 and supported by housing 562. Contacts 560 may also terminate on board 510. Traces on board 510 may connect contacts 220 in magnetic connector receptacle 210 to contacts 560 in connector insert 250. Board 510 may also support connection detection resistors, current limiting diodes, and other components as needed.

While embodiments of the present invention are well-suited for connector adapters, in other embodiments of the present invention, the MagSafe connector receptacle and USB Type-C connector insert may be connectors on a dongle or cable adapter that may also include one or more additional connector receptacles, such as an High-Definition Multimedia Interface connector receptacle, a Video Graphics Array (VGA) connector receptacle, and other types of connector receptacles.

In various embodiments of the present invention, the components of the adapters may be formed in various ways of various materials. For example, contacts or pins, interconnect lines, and other conductive portions of the adapters may be formed by stamping, metal-injection molding, printing, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the adapter housings and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide adapters that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These adapters may provide pathways for signals that are compliant with various standards such as Universal Serial Bus (USB), USB2, USB3, USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these adapters may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An adapter comprising:

a connector receptacle comprising:

a raised portion extending from a recessed surface;

a plurality of contacts having contacting surfaces at a surface of the raised portion, the plurality of contacts comprising a power contact;

a magnet;

a backplate positioned such that the magnet is between the contacting surfaces of the contacts and the backplate;

a connector insert comprising:

a plurality of contacts supported by a housing, wherein each of the plurality of contacts in the connector receptacle are coupled to at least one of the plurality of contacts in the connector insert, and at least some of the plurality of contacts in the connector insert do not couple to any of the plurality of contacts in the connector receptacle;

a board, wherein the plurality of contacts of the connector receptacle and the plurality of contacts of the connector insert terminate on the board;

a first resistor located on the board and directly connected between a connection detection contact in the plurality of contacts of the connector insert and the power contact of the connector receptacle; and a second resistor, wherein the second resistor is coupled between a connection detection contact of the connector receptacle and a ground contact of the connector insert.

2. The adapter of claim 1 wherein the plurality of contacts in the connector receptacle comprise one power contact and two ground contacts, and each is electrically connected to at least a corresponding one of the plurality of contacts in the connector insert.

3. The adapter of claim 1 wherein the connector insert is a Universal Serial Bus Type-C connector insert.

4. The adapter of claim 1 wherein the first resistor is further coupled to a power supply contact in the plurality of contacts of the connector insert.

5. The adapter of claim 1 wherein the second resistor is directly connected between the connection detection contact of the connector receptacle and the ground contact of the connector insert.

6. An adapter comprising:

a magnetic connector receptacle comprising:

a raised portion extending from a recessed surface;

a plurality of contacts having contacting surfaces at a surface of the raised portion;

a magnet; and a backplate positioned such that the magnet is between the contacting surfaces of the contacts and the backplate;

a Universal Serial Bus Type-C connector insert comprising:

a plurality of contacts supported by a housing, wherein each of the plurality of contacts in the connector receptacle are coupled to at least one of the plurality of contacts in the connector insert, and at least some of the plurality of contacts in the connector insert are disconnected from any circuitry in the adapter or any of the plurality of contacts in the connector receptacle;

a board, wherein the plurality of contacts of the connector receptacle and the plurality of contacts of the connector insert terminate on the board; and a first resistor located on the board and coupled to a connection detection contact in the plurality of contacts of the connector insert, wherein the plurality of contacts in the connector receptacle comprises a power supply contact, and wherein the power supply contact in the connector receptacle is coupled to at least a corresponding one of the plurality of contacts in the connector insert.

7. The adapter of claim 6 further comprising a second resistor coupled between a connection detection contact of the connector receptacle and a ground contact of the Universal Serial Bus Type-C connector insert.

8. The adapter of claim 6 wherein the first resistor is further coupled to a power supply contact in the plurality of contacts of the connector receptacle.

9. The adapter of claim 6 further comprising:

a first connection detection component coupled between another one of the plurality of contacts in the connector receptacle and another one of the plurality of contacts in the connector insert; and a second connection detection component coupled between one of the plurality of contacts in the connector receptacle and one of the plurality of contacts in the connector insert.

10. The adapter of claim 9 further comprising a second resistor coupled between a ground contact of the Universal Serial Bus Type-C connector insert and a connection detection contact of the connector receptacle.

11. The adapter of claim 10 wherein the second resistor is directly connected between the connection detection contact of the connector receptacle and the ground contact of the Universal Serial Bus Type-C connector insert.

12. An adapter comprising:

a MagSafe connector receptacle comprising:

a raised portion extending from a recessed surface;

a plurality of contacts having contacting surfaces at a surface of the raised portion, the plurality of contacts comprising a connection detection contact;

a magnet; and a backplate positioned such that the magnet is between the contacting surfaces of the contacts and the backplate; and a Universal Serial Bus connector insert comprising:

a plurality of contacts, wherein each of the plurality of contacts in the connector receptacle are coupled to at least one of the plurality of contacts in the connector insert, and at least some of the plurality of contacts in the connector insert do not couple to any of the plurality of contacts in the connector receptacle, the plurality of contacts comprising a ground contact;

a board, wherein the plurality of contacts of the connector receptacle and the plurality of contacts of the connector insert terminate on the board;

a first connection detection component directly connected between the connection detection contact in the connector receptacle and the ground contact in the connector insert; and a second connection detection component coupled between another one of the plurality of contacts in the connector receptacle and another one of the plurality of contacts in the connector insert, wherein the Universal Serial Bus connector insert is a Universal Serial Bus Type-C connector insert.

13. The adapter of claim 12 wherein the plurality of contacts in the MagSafe connector receptacle comprise two power contacts and two ground contacts, and each is electrically connected to at least a corresponding one of the plurality of contacts in the connector insert.

14. The adapter of claim 12 wherein the first connection detection component is a first resistor.

15. The adapter of claim 14 wherein the second connection detection component is a second resistor coupled between a connection detection contact of the connector insert and a power supply contact of the connector receptacle.

* * * * *